United States Patent [19]

Geracitano

[11] Patent Number: 4,517,914

[45] Date of Patent: May 21, 1985

[54] INFLATABLE REVERSIBLE LIFERAFT

[76] Inventor: Vincent Geracitano, 9140, 6th Ave., Montreal, P.Q., Canada, H1Z 2T8

[21] Appl. No.: 501,766

[22] Filed: Jun. 6, 1983

[30] Foreign Application Priority Data

Jun. 7, 1982 [CA] Canada ..... 404597

[51] Int. Cl.[3] ..... B63B 7/00

[52] U.S. Cl. ..... 114/345; 441/40

[58] Field of Search ..... 114/345, 346, 348–349, 114/354; 441/35–45, 129, 130

[56] References Cited

U.S. PATENT DOCUMENTS 3,748,671 7/1973 Dusmet ..... 114/345

FOREIGN PATENT DOCUMENTS 1100453 9/1955 France ..... 441/40
575615 2/1946 United Kingdom ..... 114/345
634994 3/1950 United Kingdom ..... 114/345

*Primary Examiner*—Jesûs D. Sotelo
*Attorney, Agent, or Firm*—Cushman, Darby & Cushman

[57] ABSTRACT

An inflatable, reversible liferaft designed to carry several persons and having an integral reserve buoyancy compartment which may be inflated at the discretion of the passengers in an emergency.

7 Claims, 3 Drawing Figures

INFLATABLE REVERSIBLE LIFERAFT

BACKGROUND OF THE DISCLOSURE (a) Field of Invention

The present invention relates to an inflatable, reversible liferaft designed to carry several persons and having an integral reserve buoyancy compartment which may be inflated at the discretion of the occupants of said liferaft, for example if the buoyancy of the circumferential buoyancy members or chambers should not be sufficient to support the weight of the occupants and their gear, or if one or more of the above buoyancy members or chambers should become damaged.

(b) Background of the Invention

Inflatable liferafts are known and have been used by mariners for many years, and they are also carried as emergency equipment on board of most aircraft. One of the standard designs for such inflatable liferafts comprises a single circumferential, generally tubular, inflatable buoyancy member or chamber of substantially circular or near-circular, i.e. polygonal, or substantially oval plan to which the floor of said liferaft is tangentially united so as to result in a saucer-like structure. It is evident that such a liferaft is useful only in one position, i.e. with the floor at the bottom and the buoyancy member above said floor. However, it is well known to mariners and airmen alike that it is difficult to launch such a liferaft in bad weather so as to float in the above useful position; that the action of strong winds and waves will often capsize such a liferaft before the passengers have had a chance to board it; and that it is extremely difficult, if not altogether impossible, to right such a capsized liferaft under stormy conditions.

The above considerations and experiences have led to the construction of reversible inflatable rafts having a single circumferential buoyancy member or chamber as described above to which the floor is united along the horizontal mid-line of said buoyancy member or chamber in such a manner as to form a right angle with the tangent of the cross-section of said buoyancy member at said mid-line. However, the use of such types of rafts as lifterafts has not been regarded favourably, because the above method of attachment of the floor to the buoyancy member or chamber creates an area of high stress along the line of juncture when the raft is loaded with passengers which results in comparatively rapid failure of the material in the above area.

The design and construction of reversible inflatable liferafts which is presently preferred comprises two circumferential, inflatable, generally tubular buoyancy members or chambers of substantially circular or near-circular or oval plan shape, both members or chambers of substantially identical dimensions superimposed one upon the other and fixedly united to each other along their line of juncture, with the floor being fixedly and flexibly attached to both buoyancy members or chambers long their line of juncture tangentially to the respective cross-sections of said buoyancy members or chambers at said line of juncture, for example such as described in Silverstone Canadian Pat. No. 675,042, issued Nov. 26, 1963. Such liferafts have the disadvantage of being considerably more expensive than those having a single buoyancy member or chamber, but their design and construction transfers the load exerted upon the floor more evenly to the buoyancy members than in reversible liferafts having a single buoyancy chamber.

However, even the liferafts with two superimposed buoyancy chambers such as briefly described above are known to have failed when exposed to the open sea for prolonged periods of time. The continuous flexing of the material by the action of winds and waves, in addition to the stress exerted upon the floor and upon the buoyancy chambers by the weight of the passengers have been observed to cause cracking and failure of the material to remain air-tight and impervious to water. Under such conditions the liferaft and its occupants may be lost, and it would seem to be advantageous in such an emergency to have some means of reserve buoyancy on board. In this connection it should be noted that none of the presently commercially available types of reversible inflatable liferafts provide means for reserve buoyancy.

SUMMARY OF THE INVENTION

It is an object of this invention to provide an inflatable reversible liferaft designed to carry several persons and having an integral reserve buoyancy compartment which may be inflated at the discretion of the occupants of said liferaft, for example when the buoyancy of the usual circumferential buoyancy members or chambers should not be sufficient to support the weight of the passengers while still providing a safe measure of freeboard, or if one of said buoyancy members or chambers should fail to remain air-tight, such as by cracks developed by material fatigue as described above or by chafing caused by faulty storage in a deflated condition, or if it should become punctured accidentally by floating wreckage or by some other misadventure.

The liferaft according to this invention is preferably entirely constructed of a suitable flexible material which is impermeable to air and water, for example a rubberized or plastic coated fabric which may be folded or rolled up for convenient storage of the non-inflated liferaft in confined spaces, e.g. on board of an aircraft or of a small vessel. The liferaft of this invention comprises at least one flexible, inflatable, generally tubular, circumferential buoyancy member or chamber of substantially circular or near-circular, i.e. polygonal, or of substantially oval plan shape, or a plurality of such buoyancy chambers defined as above of substantially identical dimensions superimposed upon each other and fixedly united to each other along their respective lines of juncture; a floor member of substantially the same plan shape but of somewhat smaller dimensions than the area encompassed within the inner contours of said buoyancy chambers, the dimensions of said floor member being chosen in such a manner that the floor member will easily pass through the space encompassed within the inner contours of said buoyancy chamber or chambers from one side to the other to ensure reversibility of the liferaft; with the above floor member being fixedly and flexibly united along its circumference to two substantially annular connecting members of substantially identical dimensions along their respective inner circumferences. The first of said annular connecting members is flexibly and fixedly united along the outer circumference thereof to the top of said buoyancy chamber or plurality of chambers, and the second of said annular connecting members is flexibly and fixedly united along the outer circumference thereof to the bottom of said buoyancy chamber or plurality of chambers. The space defined between said first and second annular connecting members and the inner wall surface of said buoyancy chamber or chambers constitutes the integral reserve buoyancy compartment which may be inflated at the discretion of the occupants of the liferaft; and the space defined by the floor member and one of said annular connecting members as supported along its outer circumference by the buoyancy chamber or chambers thus constitutes the passenger compartment. The dimensions of said annular connecting members are chosen in such a manner that the floor of the loaded passenger compartment will be approximately level with the bottom of the buoyancy chamber or assembly of superimposed chambers as described above.

This invention is further illustrated by the following drawings.

DETAILED DESCRIPTION OF THE INVENTION

Figure 1:
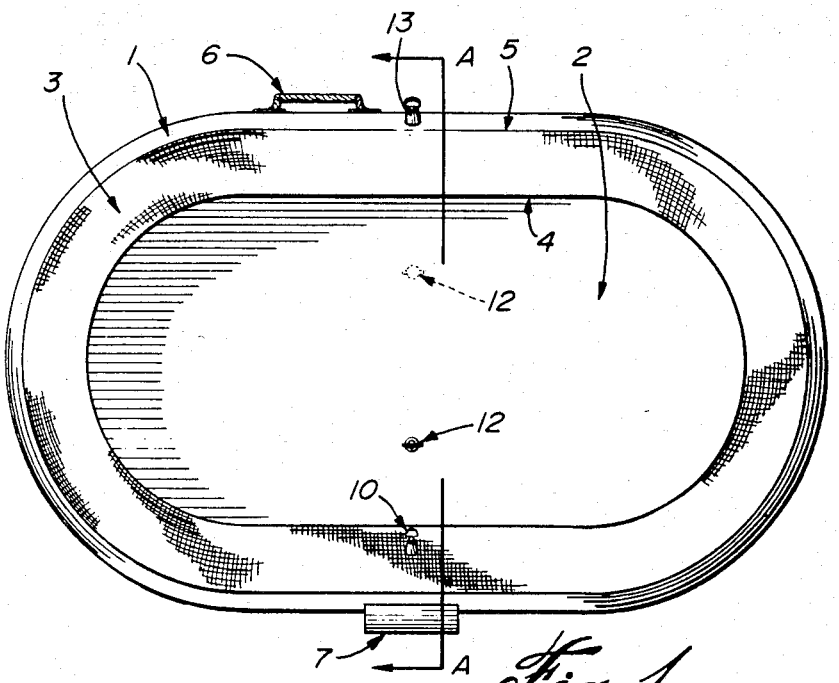
FIG. 1 shows a top plan view of one embodiment of the invention, having a substantially oval plan shape.

With reference to FIG. 1, the embodiment of the invention shown therein, i.e. a liferaft of substantially oval plan shape, is not to be interpreted as limiting the invention to that particular plan shape; the liferaft may equally well be of substantially circular or near circular, i.e. polygonal plan shape, for example such as illustrated in Canadian Pat. No. 675,042 cited above, without affecting the design of the cross-sections illustrated in FIGS. 2 and 3, and those latter cross-sections will remain the same for embodiments of this invention having substantially oval, circular, or near-circular, i.e. polygonal, plan shapes.

More specifically, the liferaft illustrated in FIG. 1 comprises a flexible, inflatable, generally tubular, circumferential buoyancy chamber 1 or a plurality of such buoyancy chambers of substantially identical dimensions superimposed upon each other and fixedly united along their line of juncture (not shown); a floor member 2 of the same general plan shape but of somewhat smaller dimensions than the area encompassed within the inner contours of said buoyancy chamber or plurality of chambers; and two substantially annular connecting members 3 of substantially identical dimensions (only one shown), both fixedly and flexibly united along their inner circumferences to the circumference 4 of the floor member 2; with the first of said annular connecting members 3 being fixedly and flexibly united along the outer circumference thereof to the top of the buoyancy chamber or plurality of chambers 1 along the line of juncture 5, and with the second annular connecting member 3 (not shown) being fixedly and flexibly united along the outer circumference thereof to the bottom (not shown) of said buoyancy chamber or plurality of chambers 1 along their line of juncture. Optionally, the liferaft may also be equipped with one or more rope slings 6 (only one shown) disposed along the outer wall surface of said buoyancy chamber or chambers 1 to facilitate boarding of the liferaft, and with one or more storage pockets 7 (only one shown) similarly disposed along the outer wall surface of said buoyancy chamber or chambers 1 for stowing emergency gear such as radio transmitter-receivers or locator beacons ("beepers"), air pump, bailers, first aid kits, food, water, fishing gear, and the like. Such pockets 7 are provided with suitable, optionally water-proof closures (not shown) which are known in the art, and are advantageously disposed at the outside of the buoyancy chamber or chambers to ensure easy access thereto in any position of the liferaft. Also shown in FIG. 1 are means 10 for inflating the reserve buoyancy compartment, as well as the optionally present means 12 for inflating the floor member 2 if the latter should have been chosen to be of double-walled construction, and the equally optionally present means 13 for re-inflating the buoyancy chamber 1. Those means 10, 12, and 13 are more fully described in the discussion of FIG. 2, see below.

Figure 2:
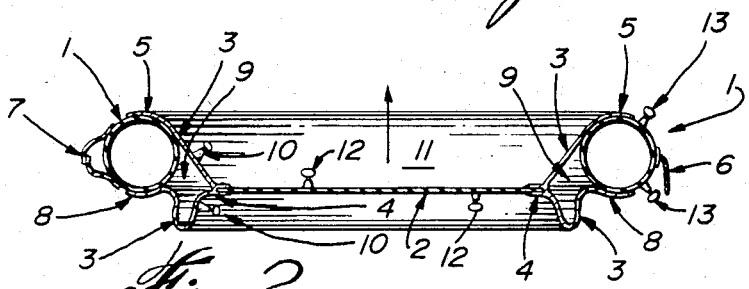
FIG. 2 is a section of the line A—A of FIG. 1 showing an embodiment of the invention having a single circumferential buoyancy chamber.

With reference to FIG. 2, a section of the line A—A of the embodiment shown in FIG. 1 having a single circumferential buoyancy chamber 1, the floor member 2 is fixedly and flexibly united along its circumference 4 with the two annular connecting members 3 at their respective inner circumferences; the first of said annular connecting members 3 is fixedly and flexibly united along its outer circumference with the top of the buoyancy chamber 1 at the line of juncture 5, and the second annular connecting member 3 is fixedly and flexibly united along its outer circumference with the bottom of the buoyancy chamber 1 at the line of juncture 8. Optional rope slings 6 and storage pockets 7 as described above (only one of each shown) are also shown suitably disposed along the outer wall surface of the buoyancy chamber 1. The space encompassed between the two annular connecting members 3 and the inner wall surface of the buoyancy chamber 1 constitutes the reserve buoyancy compartment 9 which may be inflated at the discretion of the occupants of the liferaft by appropriate means, e.g. by suitable non-return valves or closures 10. Optionally, and for the added comfort of the passengers, the floor member 2 of the passenger compartment 11 may be of suitable double-walled construction, for example such as disclosed in Canadian Pat. No. 675,042 cited above, and may be inflated separately from the reserve buoyancy compartment 9 by appropriate means, e.g. by suitable non-return valves or closures 12 to provide a modicum of insulation in cold waters. As another optional feature, the buoyancy chamber 1 may also be equipped with suitable non-return valves or closures 13 which would permit re-inflation of said buoyancy chamber 1 if it should develop a minor leak or if the initial inflation should not be sufficient. Additional optional features may include safety harnesses for the passengers, or means for anchoring such safety harnesses and are not shown in any of the drawings as such devices as well known in the art.

Figure 3:
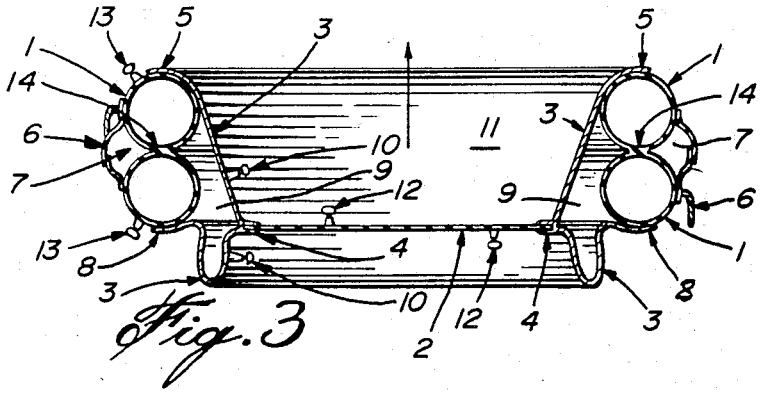
FIG. 3 is a section of the line A—A of FIG. 1 showing an embodiment of the invention having two circumferential buoyancy chambers of substantially identical dimensions superimposed upon each other and fixedly united to each other along their line of juncture.

With reference to FIG. 3, a section of the line A—A of the embodiment shown in FIG. 1 having two buoyancy chambers 1 of substantially identical shapes and dimensions superimposed upon each other, all the elements shown in FIGS. 1 and 2 and designated therein by numbers 1 to 13 inclusive are shown again with the same functions and numerical designations. However, the two buoyancy chambers 1 which are superimposed upon each other are fixedly united to each other along their line of juncture 14, and the disposition of some of the optional features may advantageously be somewhat different from that shown in FIGS. 1 and 2. For example, the rope slings 6 (two shown) may preferably be disposed in a staggered fashion along the outer wall surfaces of the two superimposed buoyancy chambers 1 so as to facilitate boarding of the inflated liferaft, and the storage pockets 7 (two shown) may advantageously be disposed between the two superimposed buoyancy chambers 1 outside and opposite their line of juncture 14 so as to provide added storage space.

In the above explanations of FIGS. 1, 2, and 3 it has been arbitrarily assumed that the line of juncture 5 is on top and that the line of juncture 8 is at the bottom. However, those skilled in the art will readily recognize that the above explanations are equally valid in the reversed position of the liferaft, i.e. with the line of juncture 8 on top and the line of juncture 5 at the the bottom, and with the floor member 2 approximately level with the line of juncture 5 which is at the bottom of the buoyancy chamber or chambers 1 when the liferaft is in the reversed position.

In general, and for any embodiment of this invention, the exact dimensions of the floor member 2 and of the substantially annular connecting members 3 will depend to a certain extent upon the physical characteristics of the material used for the construction of the liferaft of this invention, in particular upon the thickness and the flexibility of said material. However, a floor member 2 of the same general plan shape as the area encompassed within the inner contours of the buoyancy chamber or chambers 1 and having a total plan surface of from 55 to 65 percent of the latter area is useful. Furthermore, the dimensions of the substantially annular connecting members 3 are chosen in such a manner that the floor member 2 of the passenger compartment 11 will be approximately level with the bottom of the buoyancy chamber 1, or with the bottom of the lowest buoyancy chamber 1 if more than one buoyancy chamber is used, when the liferaft is loaded with passengers; or in other words, the depth of the loaded passenger compartment 11 is approximately the same as the total height of the buoyancy chamber or chambers 1. In this manner the loaded passenger compartment 11 will assume the general configuration of an inverted truncated cone closed at its lower end, i.e. the configuration of a tub, when the buoyancy chamber or chambers are of substantially circular or near-circular, i.e. polygonal, plan shape. Under the same conditions the loaded passenger compartment 11 will assume the general configuration of a bathtub when the buoyancy chamber or chambers 1 are of a substantially oval plan shape, e.g. as shown in FIG. 1.

It is a particular advantage of the liferaft of this invention that the tub-like configuration of the loaded passenger compartment 11 provides a considerable amount of buoyancy by itself, by virtue of its displacement. In consequence of said inherent buoyancy the passenger compartment will remain afloat for a sufficient amount of time after the buoyancy chamber or chambers 1 have been discovered to be damaged to enable the occupants to inflate the reserve buoyancy compartment 9.

It is another adavantage of the liferaft of this invention that the buoyancy of the reserve buoyancy compartment 9 will be at least equal to or greater than that of the buoyancy chamber or chambers 1, for the following considerations. Damage to said buoyancy chamber or chambers may be expected to be caused by chafing during faulty or careless storage, or by accidental puncture of the inflated liferaft such as by collision with floating wreckage or by some other misadventure. In any of such cases the damage may reasonably be expected to be confined to the outside parts of the wall of said buoyancy chamber or chambers, while the inside parts of said wall or walls are being protected during storage by the folded annular connecting members 3 and are not exposed to possible puncture by floating wreakage after the liferaft has been inflated. It may therefore be equally reasonably expected that the inside parts of the walls of the buoyancy chamber or chambers will remain impervious to air and water. The damaged buoyancy chamber or chambers will ultimately collapse, but inflation of the reserve buoyancy compartment will push the inside parts of the walls of said buoyancy chamber of chambers in an outward direction thus creating additional space filled with air from the reserve buoyancy compartment, so that the total volume of the inflated reserve buoyancy compartment will be at least equal to or greater than that of the original buoyancy chamber of chambers 1.

A further advantage of the liferaft of this invention is the fact that the load exerted by the passengers upon the floor member 2 and thus also upon the substantially annular connecting member 3 is transferred from the latter to the buoyancy chamber or chambers 1 at the lines of juncture 5 or 8 by means of fixed and flexible connections which are tangential to the cross-section of said buoyancy chamber or chambers, so that the stress created by the load in the areas of the lines of juncture 5 or 8 is minimized. Moreover, said stress is further reduced by the inherent buoyancy of the passenger compartment by virtue of its displacement, as discussed above, thus materially reducing the chances of failure of the material by fatigue or by chafing under the prolonged action of wind and waves.

In actual practice, the liferaft of this invention will be stored on board of a vessel or aircraft in a collapsed and suitably rolled up or folded state. It will be launched as such in case of emergency, and its buoyancy chamber or chambers will be inflated automatically upon contact with the water or semi-automatically by pulling on a cord, both by means which are well known in the art. It is another advantage of the reversible liferaft of this invention that, after having been launched and inflated the liferaft assumes a useful position, i.e. a tub-like configuration of the passenger compartment, as soon as it is boarded by passengers, independently of the manner in which it has been launched. Other advantages will be apparent to those skilled in the art.

It is it be understood that this invention is not limited to the embodiments thereof shown in FIGS. 1, 2, and 3, but that additions to or variants of those embodiments may be made without departing from the spirit of the invention. For example, the liferaft of this invention may be equipped with a protective canopy, e.g. such as described in Canadian Pat. No. 675,042 cited above. Furthermore, the material chosen for the construction of said liferaft may be varied according to type of craft on which it is to be used. In general it will be advantageous to construct all the elements of the liferaft of this invention from suitably flexibe material impervious to air and water so that the deflated liferaft may be folded or rolled up to occupy a minimum of space. That latter feature is of prime importance when the liferaft is to be carried on board of an aircraft or of a small vessel such as a pleasure yacht. However, on larger vessels where the problem of storage space is not pressing, the floor member 2 may be constructed of a comparatively rigid material, for example as a fibreglass sandwich with a foam filler to provide added buoyancy. In that latter case the liferaft may be stored on deck of the vessel, preferably in a vertical position against the wall of a deckhouse or similar structure, with the buoyancy chamber or chambers deflated, and ready for immediate, launching and use.

The embodiments of the invention in which an exclusive property or privilege is claimed are defined as follows:

1. An inflatable reversible liferaft designed to carry several persons, having an integral reserve buoyancy compartment protected against accidental damage and having a circumferential buoyancy member, said buoyancy compartment having, when inflated, sufficient buoyancy to support the weight of the passengers while still providing a safe measure of freeboard in the event said circumferential buoyancy member should fail, said liferaft further having a passenger compartment which, when loaded, possesses inherent buoyancy by virtue of its displacement, said buoyancy member comprising a flexible inflatable, generally tubular, circumferential buoyancy chamber impermeable to air and water and having a plan shape that is circular or oval, said plurality of buoyancy chambers being of substantially identical dimensions and plan shape and being superimposed upon each other and fixedly united to each other along their respective line of juncture, a flexible, water-impermeable floor member of the same general plan shape as the area encompassed within the inner contours of said buoyancy member and being of substantially smaller dimensions than said area, two substantially annular connecting members, both of substantially identical dimensions, both fixedly and flexibly united at their respective inner circumferences to the circumference of said floor member with the first of said substantially annular connecting members being fixably and flexibly united at the outer circumference thereof to the top of said buoyancy member and with the second substantially annular connecting member being fixably and flexibly united at the outer circumference thereof to the bottom of said buoyancy member.

2. An inflatable, reversible liferaft as claimed in claim 1 in which the integral reserve buoyancy compartment is defined by the space encompassed within said first and second substantially annular connecting members and the inner wall surface of said buoyancy member, and in which said integral reserve buoyancy compartment is equipped with means for inflating it at the discretion of the passengers.

3. An inflatable, reversible liferaft as claimed in claim 1 in which the dimensions of said substantially annular connecting members are chosen in such a manner that the floor of the loaded passenger compartment is substantially level with the bottom of said buoyancy member.

4. An inflatable, reversible liferaft as claimed in claim 1 in which the depth of the loaded passenger compartment is substantially the same as the height of the buoyancy member.

5. An inflatable, reversible liferaft as claimed in claim 1 in which the floor member is of double-walled construction and is equipped with means for inflating the latter separately.

6. An inflatable, reversible liferaft as claimed in claim 1 in which the buoyancy member is equipped with means for re-inflating the latter.

7. An inflatable, reversible liferaft as claimed in claim 1 in which the total volume of the inflated reserve buoyancy compartment has a volume at least equal to the total volume of the buoyancy member.

* * * * *